US006019395A

United States Patent [19]

Souparis

[11] Patent Number: 6,019,395

[45] Date of Patent: Feb. 1, 2000

[54] SAFE MARKING SYSTEM CAPABLE OF BEING PERSONALIZED

[75] Inventor: Hugues Souparis, Paris, France

[73] Assignee: Hologram-Industries, S.A., Marne la Valle Cedex, France

[21] Appl. No.: 09/141,911

[22] Filed: Aug. 28, 1998

[51] Int. Cl.[7] ..... B42D 15/00

[52] U.S. Cl. ..... 283/86; 283/94; 283/109

[58] Field of Search ..... 283/72, 74, 81, 283/86–91, 94–98, 101, 109; 354/1, 2, 15, 13

[56] References Cited

U.S. PATENT DOCUMENTS

| | | | |
|---|---|---|---|
| 5,165,725 | 11/1992 | Gollon . | |
| 5,702,805 | 12/1997 | Yin et al. | 283/86 X |
| 5,786,910 | 7/1998 | Walters | 283/86 X |
| 5,900,954 | 5/1999 | Katz et al. | 283/86 X |
| 5,939,177 | 8/1999 | Stepanek | 283/86 X |

FOREIGN PATENT DOCUMENTS 2 267 253 12/1993 United Kingdom .

*Primary Examiner*—Willmon Fridie, Jr.
*Attorney, Agent, or Firm*—Schnader Harrison Segal & Lewis LLP; Gerard J. Weiser

[57] ABSTRACT

The invention concerns a security marking system for producing a safe marking label having a substrate sheet such as a sheet coated with silicone (1) with two flaps (4,5) separated by a folding line (6), the first flap (4) supporting on the recto face a first holographic component (2), the face of which coming into contact with the substrate sheet is coated with an adhesive layer, the second flap (5) supporting on the verso face a second component (3) formed by a film coming into contact with the substrate sheet is coated with an adhesive layer and the opposite face of which at least bears official inscriptions.

10 Claims, 3 Drawing Sheets

SAFE MARKING SYSTEM CAPABLE OF BEING PERSONALIZED

BACKGROUND OF THE INVENTION

1. Field of the Invention

The present invention relates to highly secure marking labels for visible or partially coded identification of an article, such as a passport or staff identification card, or a transparent element, for example, a glass panel, such as an automobile windshield.

2. Description of the Related Art

The present invention relates to highly secure marking labels for visible or partially coded identification of an article, such as a passport or staff identification card, or a transparent element, for example, a glass panel, such as an automobile windshield. For this latter application, the information must be affixed in a definitive manner in the interior of the passenger compartment on the glass surface and be visible from the exterior. The documents in question can be, for example, vehicle registration stickers, insurance proofs-of-payment, or tax stickers. These documents bear general information supplemented by information that is specific to the vehicle or to its owner.

The general principle of such labels is described in various patents of the prior art, for example, in European patents EP 170712, EP 505689, and EP 218524, German patents DE 4405946 and DE 4414149, as well as French patent FR 2699312. In a general manner, such marking labels are composed of a support such as a plastic film imprinted on its first surface, authentication means that would be difficult for a forger to reproduce (for example, a hologram), an adhesive layer for adhering the label onto the window of a vehicle such that the inscription printed on the support can be read but the label can not be removed without being destroyed.

SUMMARY OF THE INVENTION

The applicant has developed an improved label constituted by a complex formed by two superimposed elements between which is interposed a marking element, with at least one of said elements having a layer designed to enable bonding onto the transparent support and at least one of said elements comprising a diffraction grating. The first element is formed by a transparent plastic film bearing on one of its surfaces an adhesive designed to bond said element onto the transparent support to be marked and having on the other surface an easily broken layer and a transparent lacquer layer stamped with a holographic image. The second element is constituted by a transparent film coated with an easily broken layer and a metallized lacquer layer stamped with a holographic image and by an adhesive designed to bond the element onto the transparent support to be marked and onto the element These labels exhibit a high degree of security. However, their fabrication requires industrial means that are not adapted to small production runs.

The object of the present invention is to resolve this drawback by proposing a highly secure marking label that enables individualization without industrial tooling. For this purpose, the invention relates to a security marking system for the implementation of a highly secure marking label, characterized in that it is constituted by a support sheet such as a siliconized plastic sheet, having two flaps separated by a folding line, with the first flap bearing on the recto surface a first holographic component, the surface of which that comes into contact with the support sheet being coated with an adhesive layer, and with the second flap bearing on the verso surface a second component formed by a film, the surface of which that comes into contact with the support sheet being coated with an adhesive layer, and at least the opposite surface of which bears an official personalization inscription.

Advantageously, the two components are arranged in a manner such that they are superimposed when the support sheet is folded along the folding line.

Preferably, the dimensions of the first component are larger than the dimensions of the second component.

According to a preferred variant, the first flap has, at the level of the first component, a tab that has been perforated on three sides, with the dimensions of this zone being smaller than the dimensions of the first component, with this tab being optionally folded so as to allow bonding between the two components.

According to a variant of implementation, the second component bears in addition inscriptions affixed on the adhesive surface.

According to another variant of implementation, the first component has individualization inscriptions affixed on the exterior surface.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
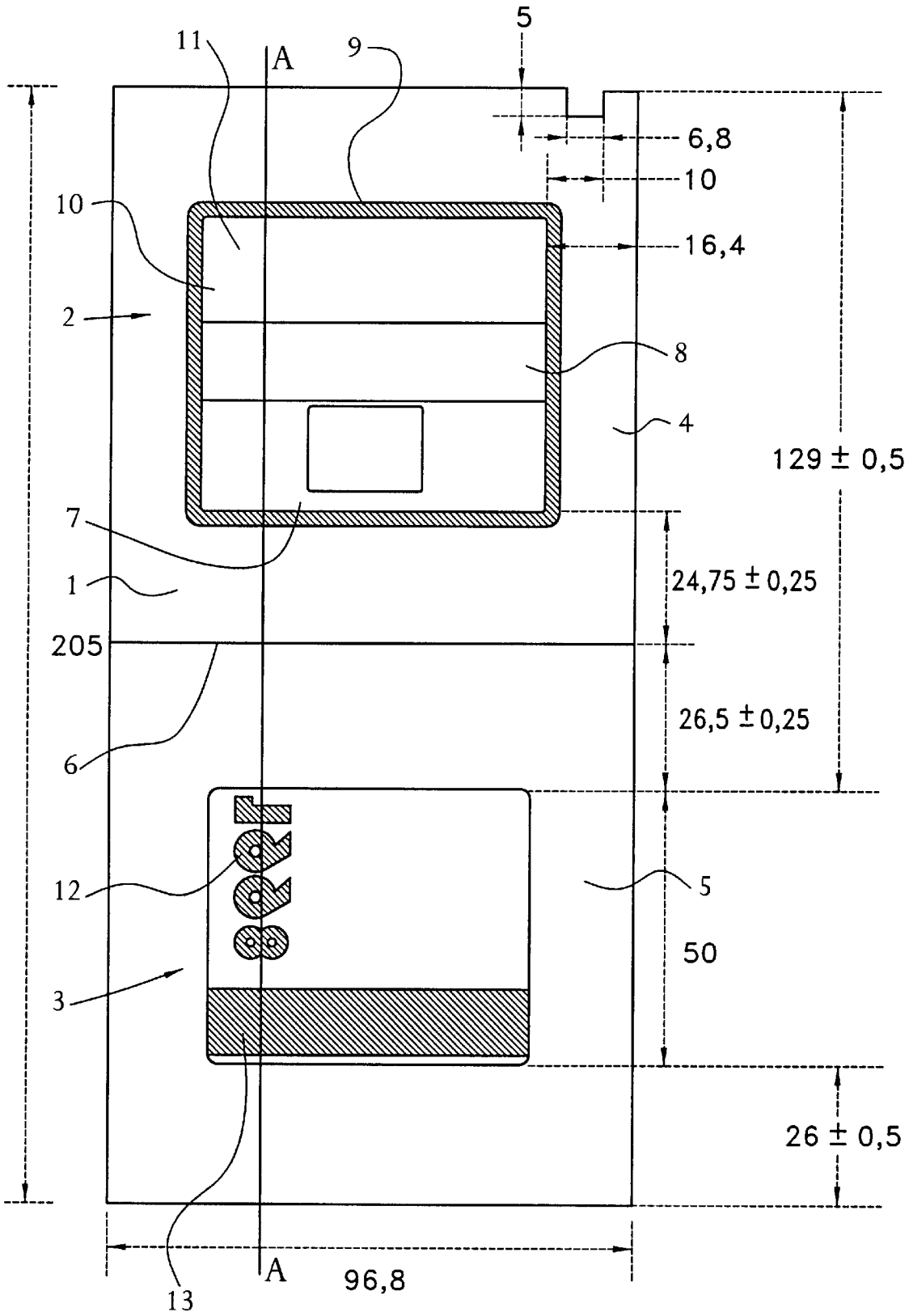
FIG. 1 represents a front view of a system according to the invention.

FIG. 1 represents a view of the verso side of a marking system according to the invention. It is formed by a siliconized sheet 1 constituting the support of the two components 2 and 3. This sheet has two flaps 4, 5 separated by a folding line, for example, a scored line 6. The two flaps 4, 5 have substantially identical dimensions which are larger than those of the two components 2, 3.

The first flap 4 has a zone that is perforated on three sides 7–9 and scored on the fourth side 10, so as to delimit a foldable tab 11. This tab has a dimension smaller than that of the first component 2 adhered onto the recto surface, i.e., the surface opposite to that shown in FIG. 1.

The second flap 5 bears on its verso surface, i.e., the surface that is visible in FIG. 1, the second component 3 formed by a transparent plastic film bearing an inscription 12 affixed in opaque or translucent ink on the transparent film, and a second printed zone 13 affixed on an opaque zone. The printing 13 is performed on the exterior surface, i.e., the surface opposite the adhesive surface adhered to the support film 1.

The two components 2, 3 are arranged on the support film 1 in a symmetrical manner in relation to the line 6 in a manner such that the second component 3 comes into position, when the flaps are folded on top of each other, on the back of the first component 2, at the level of the zone delimited by the lines 7–10. Before this operation, the tab 11 is folded so as to release the central part of the back of the first component 1 and to enable the adhering of the second component onto the first component.

Figure 2:
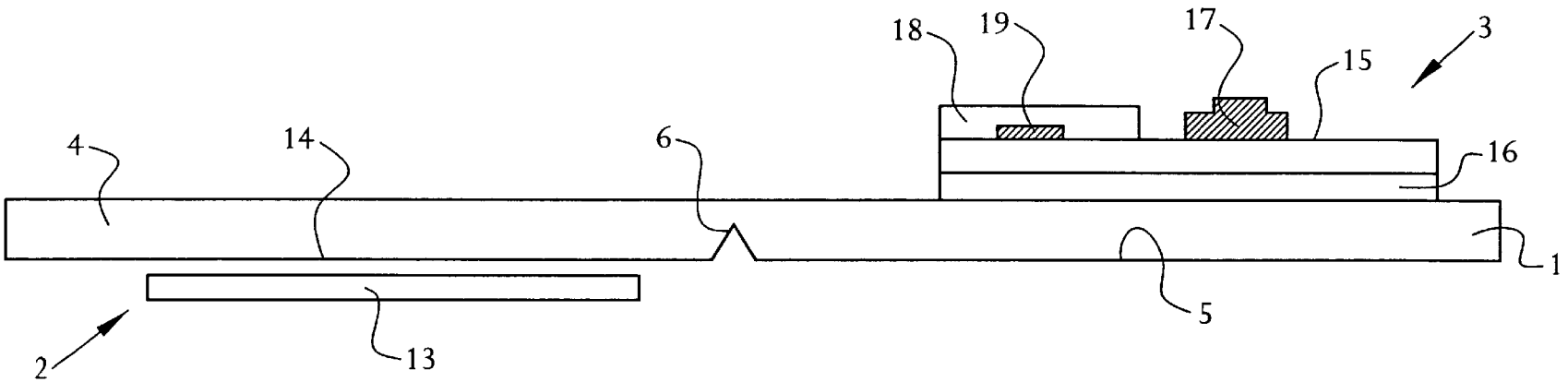
FIG. 2 represents a sectional view of a system according to the invention.

FIG. 2 represents a view along a section AA of the marking system represented in FIG. 1. The thicknesses are exaggerated so as to make it easier to read the drawing.

The first component 2 is a holographic component formed, for example, by a stamped metallized lacquer layer 13 covered by an adhesive 14. This component can present one or more holographic compositions, as well as optionally a transparent zone allowing inscriptions carried on the second component to come into view. The holographic component is stamped on the two surfaces in a manner such as to present holographic images on both sides of the label being created.

The second component 5 is formed by a transparent film 15 also bearing an adhesive layer 16 and different printings 17 or 19. Certain inscriptions 17 are formed by opaque or translucent inks on the transparent background. Other inscriptions 19 are covered by an opaque ink 18 also forming an easily broken layer. Other inscriptions can be manually transferred onto the back of the film before the two components are brought together, so as to individualize the marking label created in this manner.

Figure 3:
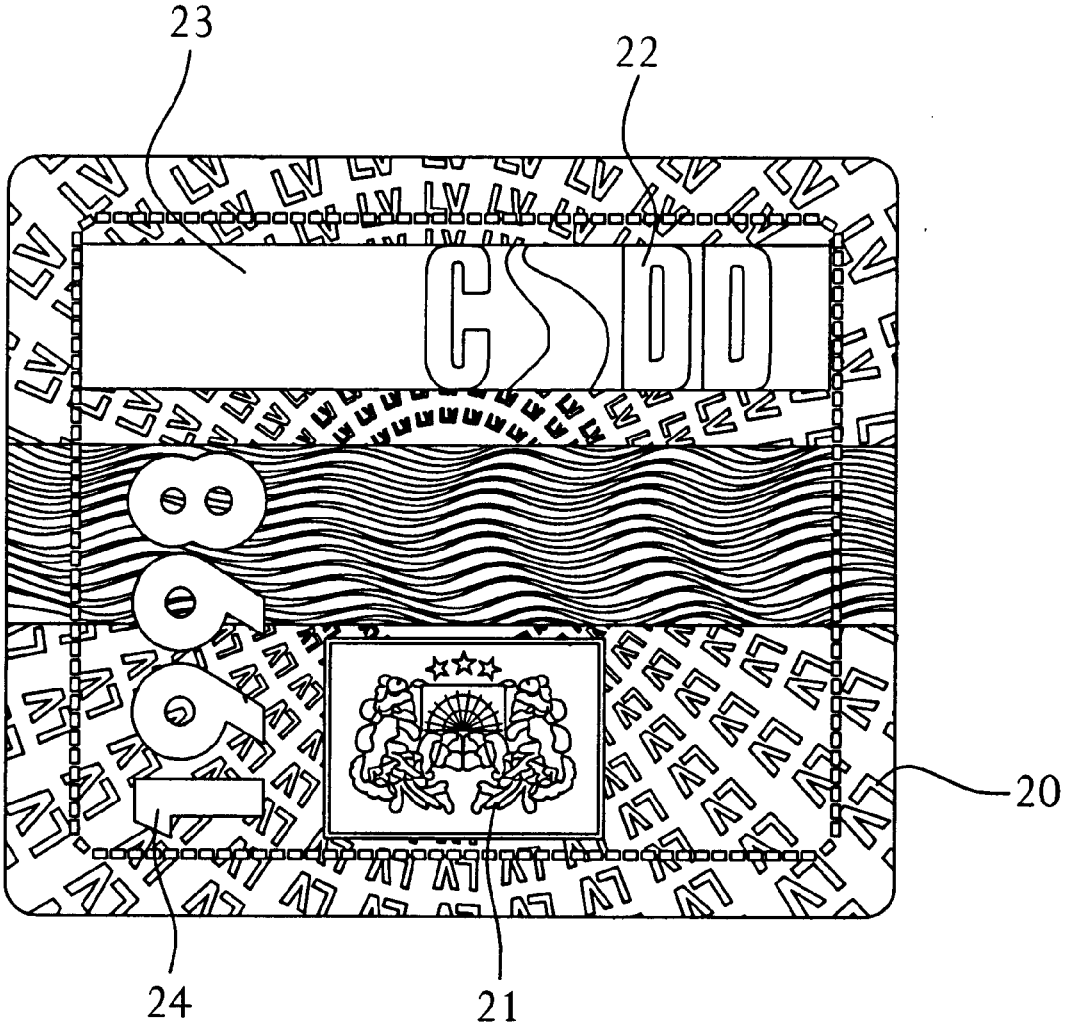
FIG. 3 represents a view of the label obtained by the system according to the invention.

FIG. 3 represents a view of a label created according to the invention. The two components were superimposed and laminated in a known manner. The label is thus formed on the first flap 4, the tab 11 of which can once again be put in position so as to protect the adhesive surface. The label seen from the back (surface of the first component 2 initially adhered onto the support sheet) allows one to see the diffraction zones 20, 21 and the printed zones, certain of which (e.g., 22) are seen in contrast with an opaque background 23 and other imprintings 24 are seen on a transparent background allowing the holographic images of the first component to become visible.

The invention is described in the preceding as a nonlimitative example. It is clearly understood that the Expert in the Field could implement different variants without going beyond the scope of the invention.

In particular, the holographic component can be constituted by a transparent hologram or by a transparent or metallized destructible hologram. Destructible holograms have an easily broken layer that is irreversibly damaged by attempted detachment.

The second component can be opaque or transparent, or only partially opaque. A system composed of a transparent hologram and a second partially transparent component will allow one to see the inscriptions on the support on which said component is affixed, for example a passport or an identification card.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A security marking system for creating a secure marking label, comprising a substrate having first and second flaps separated by a folding line, wherein:

the first flap bearing on a recto surface a first holographic component, a surface of which coming into contact with the substrate and having an adhesive layer; and the second flap bearing on a verso surface a second component formed by a film, a surface of which coming into contact with the substrate and being coated with an adhesive layer and an opposite surface of which bearing an inscription.

2. The security marking system of claim 1, wherein the first and second components are arranged in a manner such that they become superimposed when the substrate is folded along the folding line.

3. The security marking system of claim 1, wherein the first component is larger than the second component.

4. The security marking system of claim 1, wherein the first flap has, at the level of the first component, a tab that is perforated along three sides, wherein the tab is smaller than the first component and the tab is capable of being folded so as to allow bonding between the first and second components.

5. The security marking system of claim 1, wherein the second component bears an inscription affixed to its adhesive surface.

6. The security marking system of claim 1, wherein the first component has individualization inscriptions affixed on its exterior surface.

7. The security marking system of claim 1, wherein the first component is at least partially transparent.

8. The security marking system of claim 1, wherein the second component is at least partially transparent.

9. The security marking system of claim 1, wherein the first component is adapted to be destroyed if an attempt is made to detach the system.

10. The security marking system of claim 1, wherein:

the first and second components are arranged in a manner such that they become superimposed when the substrate is folded along the folding line;

the first component is larger than the second component;

the first flap has, at the level of the first component, a tab that is perforated along three sides, wherein the tab is smaller than the first component and the tab is capable of being folded so as to allow bonding between the first and second components;

the second component bears an inscription affixed to its adhesive surface;

the first component has individualization inscriptions affixed on its exterior surface;

the first component is at least partially transparent;

the second component is at least partially transparent; and the first component is adapted to be destroyed if an attempt is made to detach the system.

* * * * *